US009577398B2

(12) United States Patent
Nagase et al.

(10) Patent No.: US 9,577,398 B2
(45) Date of Patent: Feb. 21, 2017

(54) ASSISTING TOOL FOR CONNECTOR

(71) Applicant: Molex, LLC, Lisle, IL (US)

(72) Inventors: Teruki Nagase, Yamato (JP); Masahiro Osawa, Yamato (JP); Koji Chikano, Setagaya (JP)

(73) Assignee: Molex, LLC, Lisle, IL (US)

( * ) Notice: Subject to any disclaimer, the term of this patent is extended or adjusted under 35 U.S.C. 154(b) by 243 days.

(21) Appl. No.: 14/358,090

(22) PCT Filed: Dec. 21, 2012

(86) PCT No.: PCT/US2012/071126
§ 371 (c)(1),
(2) Date: May 14, 2014

(87) PCT Pub. No.: WO2013/096717
PCT Pub. Date: Jun. 27, 2013

(65) Prior Publication Data

US 2014/0304985 A1 Oct. 16, 2014

(30) Foreign Application Priority Data

Dec. 21, 2011 (JP) ..... 2011-279952

(51) Int. Cl.

| | |
|---|---|
| ***H01R 43/26*** | (2006.01) |
| ***H01R 13/629*** | (2006.01) |
| ***H01R 43/22*** | (2006.01) |
| ***H01R 43/20*** | (2006.01) |
| ***H01R 43/18*** | (2006.01) |
| ***H01R 12/79*** | (2011.01) |
| ***H01R 13/633*** | (2006.01) |
| *H01R 13/639* | (2006.01) |

(52) U.S. Cl.
CPC ..... *H01R 43/26* (2013.01); *H01R 12/79* (2013.01); *H01R 13/629* (2013.01);
(Continued)

(58) Field of Classification Search
CPC ..... H01R 13/629; H01R 13/62933; H01R 13/62938; H01R 13/62944; H01R 13/6335; H01R 13/639; H01R 12/79; H01R 41/18; H01R 41/20; H01R 41/22; H01R 41/26; H01R 43/18; H01R 43/20; H01R 43/22; H01R 43/26; Y10T 29/53222; Y10T 29/53283; Y10T 29/53209
See application file for complete search history.

(56) References Cited

U.S. PATENT DOCUMENTS 5,344,194 A 9/1994 Hatagishi et al.
5,393,238 A 2/1995 Saito
(Continued)

FOREIGN PATENT DOCUMENTS

CN 1952464 A 4/2007
JP 2005063716 A * 3/2005
(Continued)

OTHER PUBLICATIONS

International Search Report for PCT/US2012/071126.

*Primary Examiner* — A. Dexter Tugbang
(74) *Attorney, Agent, or Firm* — James A. O'Malley

(57) ABSTRACT

The assisting tool for a connector includes a mounting member able to be mounted in a first housing having a first connector able to mate with a second connector in a second housing, and an operating member able to rotate with respect to the mounting member. Here, the operating member has a lever portion, the operating member is mounted in the first housing, and the lever portion contacts the second housing and applies pressure to the second housing in the direction releasing the mated first connector and second connector when the operating member is rotated while the first connector is mated with the second connector.

7 Claims, 14 Drawing Sheets

(52) U.S. Cl.
CPC . *H01R 13/62933* (2013.01); *H01R 13/62938* (2013.01); *H01R 13/62944* (2013.01); *H01R 13/6335* (2013.01); *H01R 43/18* (2013.01); *H01R 43/20* (2013.01); *H01R 43/22* (2013.01); *H01R 13/639* (2013.01); *Y10T 29/53209* (2015.01); *Y10T 29/53222* (2015.01); *Y10T 29/53283* (2015.01)

(56) References Cited

U.S. PATENT DOCUMENTS

| | | | | |
|---|---|---|---|---|
| 5,425,169 | A * | 6/1995 | Steinman | H01R 13/62933 29/267 |
| 5,938,458 | A | 8/1999 | Krehbiel et al. | |
| 6,019,620 | A | 2/2000 | Kodama et al. | |
| 6,056,582 | A | 5/2000 | Okabe | |
| 7,374,447 | B2 | 5/2008 | Matsumoto | |
| 7,568,925 | B2 * | 8/2009 | Ciriello | H01R 13/62944 439/157 |
| 7,641,486 | B2 * | 1/2010 | Tonosaki | H01R 13/62944 439/157 |
| 7,661,969 | B2 | 2/2010 | Nagano et al. | |
| 7,811,105 | B1 | 10/2010 | Tan Chin Yaw et al. | |
| 8,215,970 | B2 | 7/2012 | Shamoto et al. | |
| 2009/0246991 | A1 | 10/2009 | Shuey | |

FOREIGN PATENT DOCUMENTS

| | | | |
|---|---|---|---|
| JP | 2005-093112 | A | 4/2005 |
| TW | M332342 | U | 5/2008 |

* cited by examiner

ASSISTING TOOL FOR CONNECTOR

REFERENCE TO RELATED APPLICATIONS

The Present Disclosure claims priority to Japanese Patent Application No. 2011-279952, entitled "Assisting Tool For Connector," and filed 21 Dec. 2011 with the Japanese Patent Office. The content of this Application is incorporated in its entirety herein.

BACKGROUND OF THE PRESENT DISCLOSURE

The Present Disclosure relates, generally, to an assisting tool for a connector, and, more particularly, to an assisting tool which is able to mount a mounting member in a first housing of a first connector mated with a second connector, to release the first connector from the second connector using a simple operation, and to improve the operability and expand the range of uses for small, low-profile connectors without damaging or destroying the first and second connectors during the release operation.

The use of an assisting tool, such as a lever, is typical for removing a connector, mated with a substrate-side connector mounted on the surface of a substrate, such as a circuit board, from the substrate-side connector. One example is disclosed in Japanese Patent Application No. 2003-321217, the content of which is incorporated herein in its entirety.

FIG. 14 shows a perspective view of a conventional assisting tool used to remove a connector. In FIG. 14, 901 is a substrate-side connector, which is a surface-mounted connector mounted on the surface of a substrate 991 such as a circuit board. 801 is a device-side connector mated with the substrate-side connector 901, which is accommodated inside a casing 811 also accommodating, for example, an optical communication device. Also, 851 is a multi-core tape-like optical fiber connected to one end of the casing 811.

A release lever 871 is rotatably connected to the other end of the casing 811. A piston 874 is slidably mounted on the other end of the casing 811 in the vertical direction. When the release lever 871 is rotated in the direction of the arrow, the hammer portion 873 mounted on the drive shaft end of the lever body 872 pushes down on the plate body 874*b* of the piston 874 towards the upper face of the tiered block 875 in the casing 811. The sliding body 874*a* of the piston 874 is lowered, and the lower face of the sliding body 874*a* presses down on the surface of the substrate 991. The casing 811 is lifted up by the substrate 991, and the device-side connector 801 accommodated inside the casing 811 is removed from the substrate-side connector 901.

However, because the assisting tool of the prior art is attached to the large casing 811 accommodating the device-side connector 801, the tool is large. As a result, it can be difficult to apply to a small, low-profile connector, such as a connector used to connect a substrate to a cable. As electronic devices have become smaller and lower in profile, the connectors mounted inside the cases of these electronic devices have also become smaller and lower in profile. Also, as the mounting density of components mounted on the surface of a substrate has increased, almost no space remains around a connector mounted on the surface of a substrate. As a result, these connectors can no longer be practicably applied to a large member such as a casing 811. Further, it is difficult to remove a mated connector from a connector mounted on the surface of a substrate in a small electronic device because the connector itself is small and the space is narrow. Therefore, the use of an assisting tool has been considered for removing connectors. Here, the device-side connector 801 is already housed in the casing 811. It is assumed that this tool is not applied to a device-side connector 801 after the fact.

SUMMARY OF THE PRESENT DISCLOSURE

The purpose of the Present Disclosure is to solve the problem associated with conventional assisting tools by providing an assisting tool for a connector which is able to mount a mounting member in a first housing of a first connector mated with a second connector, to release the first connector from the second connector using a simple operation, and to improve the operability and expand the range of uses for small, low-profile connectors without damaging or destroying the first and second connectors during the release operation.

The Present Disclosure discloses an assisting tool for a connector including a mounting member mounted in a first housing having a first connector mated with a second connector in a second housing, and an operating member able to rotate with respect to the mounting member. Here, the operating member has a lever portion and is mounted in the first housing, and the lever portion contacts the second housing and applies pressure to the second housing in the direction releasing the mated first connector and second connector when the operating member is rotated while the first connector is mated with the second connector.

The Present Disclosure also discloses an assisting tool for a connector in which the operating member has an engaging portion able to engage an engaged portion formed on the outer face of a side wall portion of the first housing. The Present Disclosure further discloses an assisting tool in which the lever portion contacts the mating side of a side wall portion of the second housing and applies pressure to the second housing when the operating member is rotated. The Present Disclosure additionally discloses an assisting tool in which the mounting member has a plate-like mounting portion, and the mounting portion can be inserted between an outer face of a side wall portion of the first housing and an inner face of a side wall portion of a second housing while the first connector is mated with the second connector. The Present Disclosure moreover discloses an assisting tool in which the mounting member is able to be mounted in the first housing while the first connector is mated with the second connector and before the second connector is mated. The Present Disclosure likewise discloses an assisting tool in which the operating member has a bearing portion for rotatably and slidably accommodating a rotating shaft fixed to the operating member, and a hook portion able to engage a hooked portion formed in a side wall portion of the second housing. Here, the hook portion engages and disengages the hooked portion by sliding the operating member.

The assisting tool for a connector of the Present Disclosure is able to mount a mounting member in a first housing of a first connector mated with a second connector, to release the first connector from the second connector using a simple operation, and to improve the operability and expand the range of uses for small, low-profile connectors without damaging or destroying the first and second connectors during the release operation.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
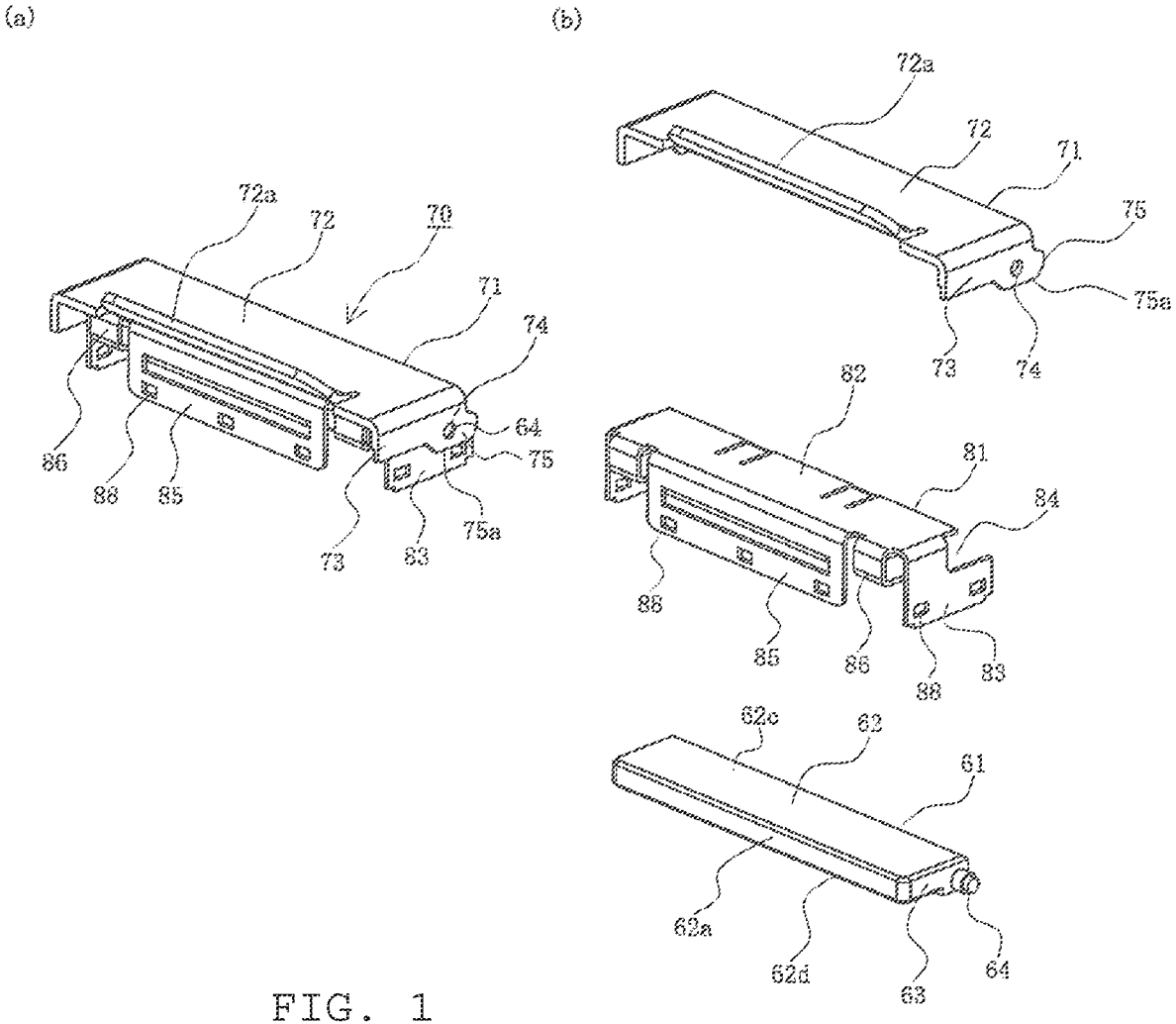
FIG. 1 shows perspective views of an assisting tool for a connector according to an embodiment of the Present Disclosure, as viewed from the front in which FIG. 1(*a*) is an assembled view, and FIG. 1(*b*) is an exploded view.
Figure 2:
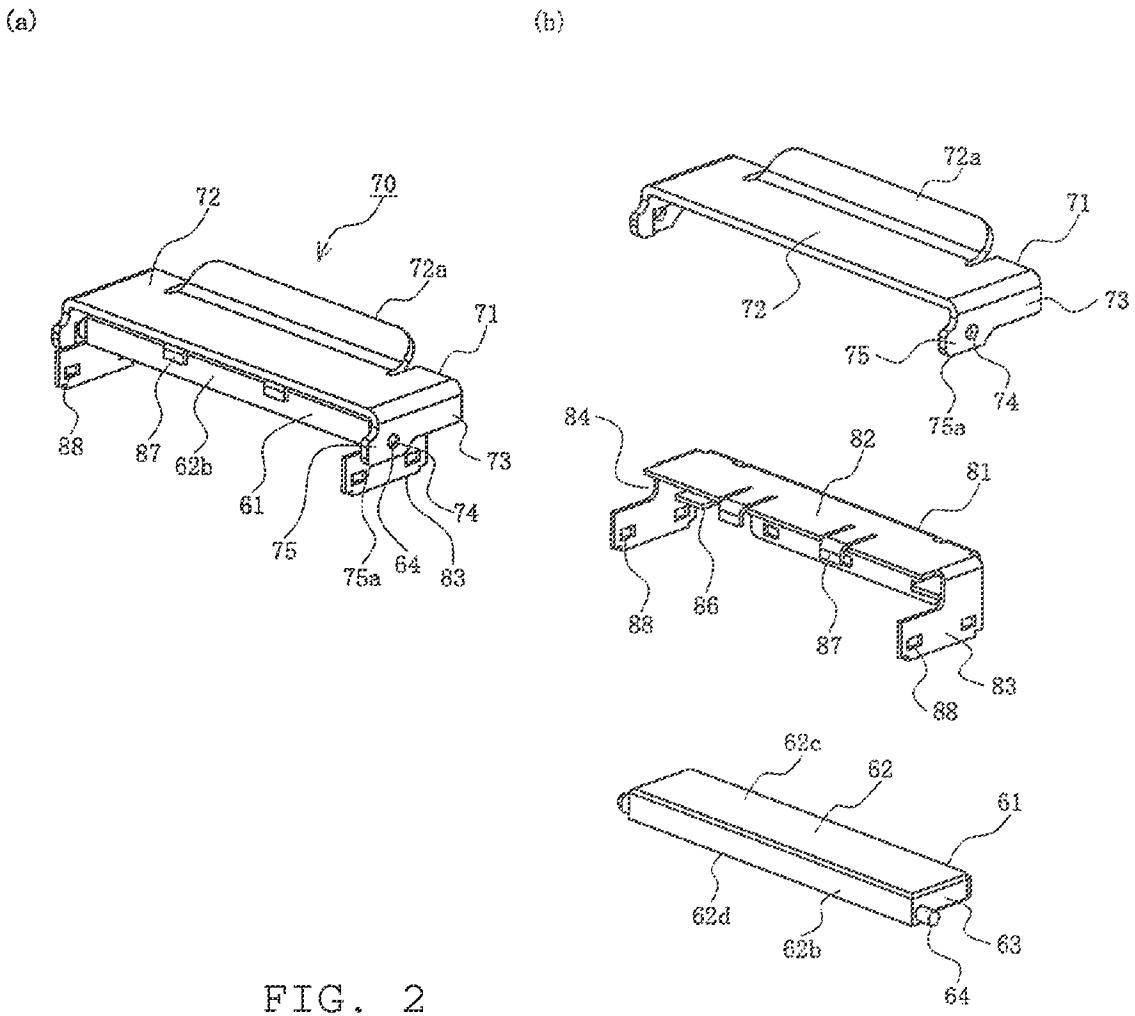
FIG. 2 shows perspective views of the tool of FIG. 1, as viewed from the rear in which FIG. 2(*a*) is an assembled view, and FIG. 2(*b*) is an exploded view.

Referring to the Figures, and, in particular, FIGS. 1-2, 70 is an assisting tool for a connector according to one embodiment. This tool is attached to a first connector 1 described below, and the first connector 1 is removed from a mated second connector 101 described below. This tool can also be used to mate the first connector 1 with the second connector 101. The first connector 1 and the second connector 101 can be any type of matable connector. In the present example, the second connector 101 is a surface-mounted connector mounted on the surface of a substrate used in an electronic device, and the first connector 1 is a surface-mounted connector mounted on the surface of a flexible flat cable or flexible printed circuit (FPC).

The assisting tool 70 has an operating member 71, a mounting member 81 mounted on the first connector 1, and an intermediate member 61 joined to the operating member 71 and the mounting member 81. Typically, the operating member 71 and the mounting member 81 are created by bending or punching a metal plate, or by integrally molding an insulating material. Typically, the intermediate member 61 is integrally molded from an insulating material, but can also be integrally formed from a metal.

The operating member 71 has a top panel portion 72, which is a flat plate with a substantially rectangular planar shape, and side panel portions 73, which are flat plates extending downward from both ends of the top panel portion 72 and connected so as to be orthogonal to the edge. The pair of side panel portions 73 is parallel to each other. The side panel portions 73 are also substantially rectangular, and include protruding portions 75 protruding to the rear and downward from the lower rear end corners. Bearing portions 74, which include a through-hole formed in the thickness direction, are located near the lower rear end corners. The protruding portions 75 function as lever portions when the first connector 1 is removed from the second connector 101 as described below, and the bottom faces of the lower rear ends function as abutting face 75*a* abutting the second housing 111 of the second connector 101.

A cut-and-raised portion 72*a* is formed in the front edge of the top panel portion 72. The cut-and-raised portion 72*a* is formed to allow the operator to operate the operating member 71 with a finger when the first connector 1 is removed from the second connector 101, and when the first connector 1 is mated with the second connector 101.

The mounting member 81 has a plate-shaped frame portion 82 with a rectangular planar shape, plate-shaped side mounting portions 83 connected and extending downward orthogonal to the edges of the frame portion 82 in the length direction, and a front mounting portion 85 serving as a plate-shaped mounting portion connected and extending downward, orthogonal to the front edge of the frame portion 82. The pair of side mounting portions 83 is in parallel. The side mounting portions 83 are substantially L-shaped plates in which a portion extending vertically joins a portion extending longitudinally. The portion extending longitudinally extends to the rear of the rear edge of the frame portion 82. A rotating shaft accommodating recessed portion 84 is formed between the edge of the frame portion 82 in the width direction, and the portion of the side mounting portion 83 extending vertically, as well as the portion of the side mounting portion 83 extending longitudinally. The rotating shaft 64 of the intermediate member 61 is disposed inside the rotating shaft accommodating recessed portion 84. The side mounting portion 83 includes an engaging portion 88 (two shown), a through-hole formed near the lower edge to pass through in the thickness direction. The engaging portion 88 engages an engaged portion 18 in the first housing 11 of the first connector 1 described below. In this way, the side mounting portion 83 is mounted on the first housing 11 of the first connector 1.

Similarly, the front mounting portion 85 includes an engaging portion 88 (two shown), a through-hole formed near the lower edge so as to pass through in the thickness direction. Because the engaging portion 88 engages an engaged portion 18 in the first housing 11 of the first connector 1 described below, the front mounting portion 85 is also mounted on the first housing 11 of the first connector 1.

Also, an intermediate member front holding portion 86 is formed on both sides of the front mounting portion 85 on the front edge of the frame portion 82. The intermediate member front holding portions 86 have a substantially L-shaped profile, where a portion extending vertically joins a portion extending longitudinally. The portion extending vertically holds the intermediate member 61 from the front, and the portion extending longitudinally holds from below. A pair of intermediate member rear holding portions 87 is connected on the rear edge of the frame portion 82. The intermediate member rear holding portions 87 extend downward from the rear edge of the frame portion 82 and hold the intermediate member 61 from the rear.

The intermediate member 61 includes a thick, plate-shaped main portion 62 with a substantially rectangular planar shape, and a column-shaped rotating shaft 64 extending outward from the side face portion 63 on both longitudinal sides of the main portion 62. The rotating shafts 64 are inserted into the bearing portions 74 of the operating member 71, and are rotatably held by the bearing portions 74. When the main portion 62 is held by the mounting member 81, the upper panel 62*c* faces the frame portion 82, the front panel 62*a* and the lower panel 62*d* face the intermediate member front holding portion 86, and the rear panel 62*b* faces the intermediate member rear holding portion 87.

Preferably, when the operating member 71, the mounting member 81 and the intermediate member 61 are assembled, the intermediate member 61 is mounted in the mounting member 81 before the rotating shafts 64 of the intermediate member 61 are inserted into the bearing portions 74 and the operating member 71 is mounted. More specifically, the main portion 62 is held by the intermediate member front holding portion 86 and the intermediate member rear holding portion 87 so that the upper panel 62*c* of the main portion 62 of the intermediate member 61 faces the lower face of the frame portion 82 of the mounting member 81. The rotating shafts 64 are accommodated inside the rotating shaft accommodating recessed portions 84, and at least the tip of the rotating shafts 64 extend to the outside from the side mounting portions 83. The intermediate member 61 is mounted and fixed in the mounting member 81 in this way. The operating member 71 is mounted in the intermediate member 61 by inserting the tips of the rotating shafts 64 into the bearing portions 74 so that the top panel portion 72 of the operating member 71 covers the upper face of the frame portion 82 of the mounting member 81. In this way, the operating member 71 can be rotated or pivoted around the rotating shafts 64 relative to the intermediate member 61 and the mounting member 81. In this way, the assisting tool 70 shown in FIGS. 1(*a*) and 2(*a*) can be obtained.

Figure 3:
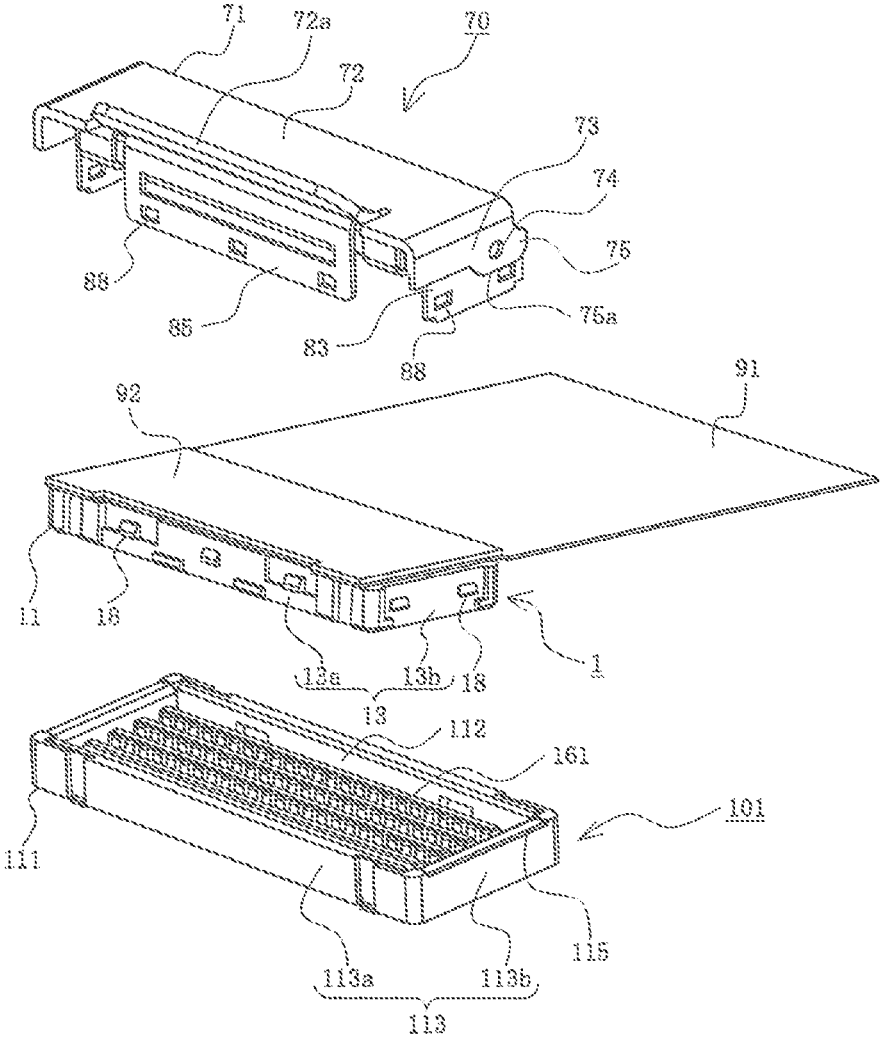
FIG. 3 shows a perspective view showing the relationship between the tool of FIG. 1 and the first and second connectors.
Figure 4:
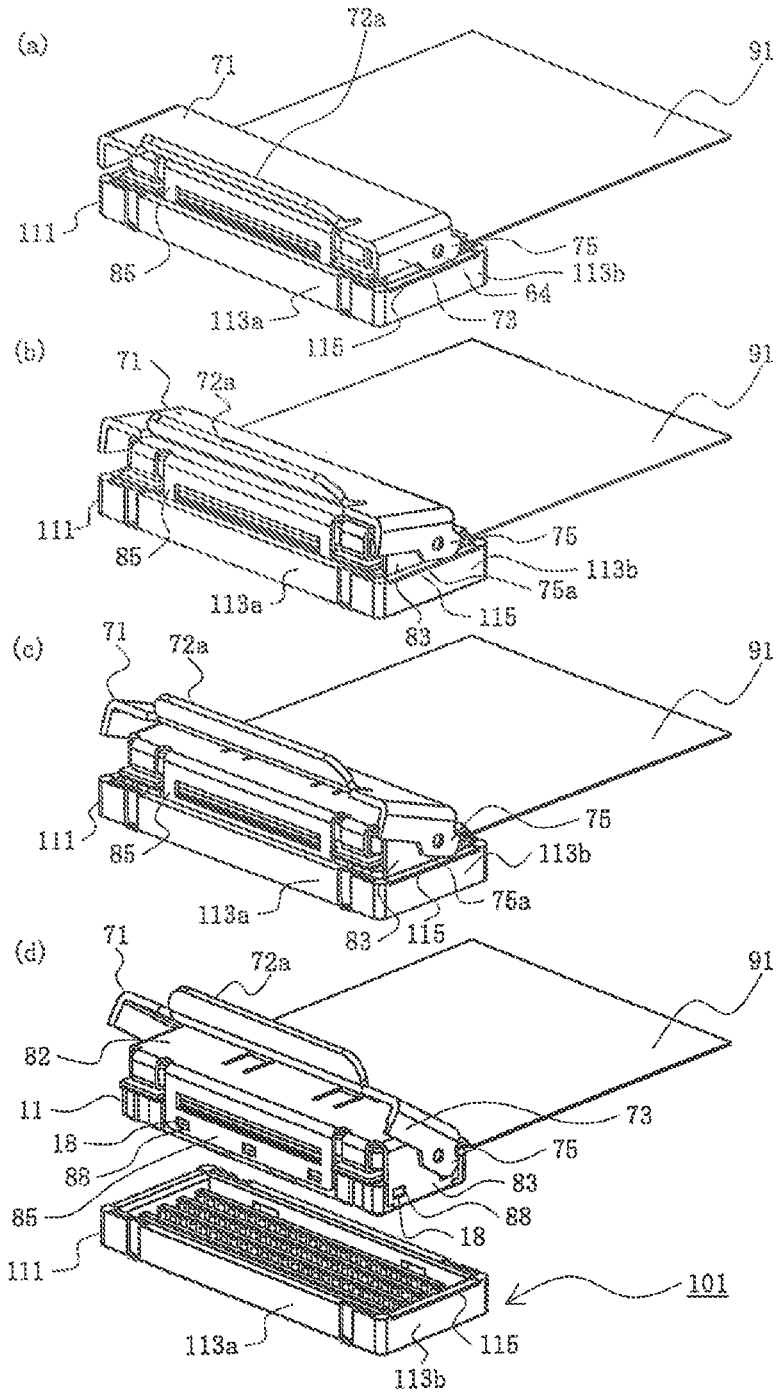
FIG. 4 shows perspective views used to explain steps (a)-(d) of the removal operation, to remove the first connector from the second connector using the tool of FIG. 1.
Figure 5:
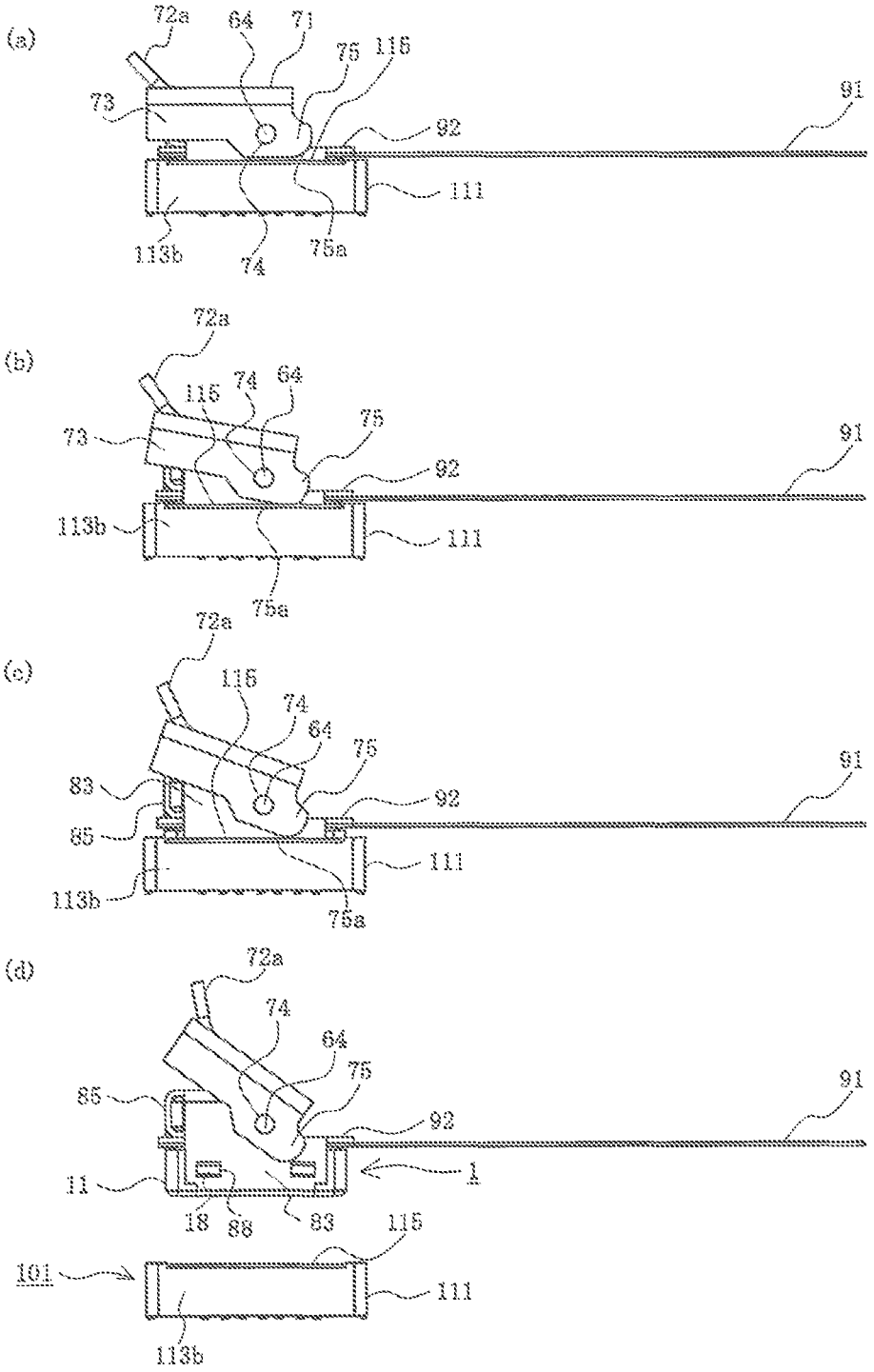
FIG. 5 shows side views used to explain steps (a)-(d) of the removal operation of FIG. 4.

FIGS. 3-5 describe the operation of an operating member 71 with the configuration described above. FIG. 3 shows the first connector 1 and the second connector 101 before they have been mated. The assisting tool 70 has not yet been mounted on the first connector 1.

The second connector 101 has a second housing 111 serving as the main body of the connector. This housing is integrally molded from an insulating material. As shown in the Figures, the second housing 111 is a thick-plated rectangular case, and a substantially rectangular recessed portion 112 is formed between side wall portions 113 on the side mated with the first connector 1 (the upper end in FIG. 3). The side wall portions 113 include long wall portions 113*a* extending in the long axis direction of the second housing 111, and short wall portions 113*b* extending in the short axis direction of the second housing 111.

The upper face, or mated face, of the short wall portions 113*b* function as an abutted face 115, which is abutted by the abutting faces 75*a* of the protruding portions 75 of the operating member 71 of the assisting tool 70. Because the abutted face 115 receives sliding pressure from the abutting face 75*a* of a protruding portion 75, a wear-resistant member is preferably applied.

Rows of second terminals 161 are arranged inside the recessed portion 112 in the long axis direction of the second housing 111. The second connector 101 is mounted on the surface of the substrate by soldering the tails of the second terminals 161 to terminal-connecting pads connected to a conductive trace on the substrate.

Also, the first connector 1 has a first housing 11 serving as the main body of the connector. This housing is integrally molded from an insulating material. As shown in the Figures, the first housing 11 is a thick-plated rectangular case, and a substantially rectangular recessed portion is formed between side wall portions 13 on the side mated with the second connector 101 (the lower end in FIG. 3). The side wall portions 13 include long wall portions 13*a* extending in the long axis direction of the first housing 11, and short wall portions 13*b* extending in the short axis direction of the first housing 11.

Engaged portions 18, which are protrusions formed to extend outward, are formed on the outer faces of the long wall portions 13*a* and the short wall portion 13*b*. The engaged portions 18 engage the engaging portions 88 of the mounting member 81 of the assisting tool 70. In this way, the assisting tool 70 is mounted in the first housing 11 of the first connector 1. The shape of the protrusion-like engaged portions 18 preferably has an upper face in FIG. 3 which is inclined with respect to the outer faces of the long wall portions 13*a* and the short wall portions 13*b*, and a lower face in FIG. 3 which is orthogonal with respect to the outer faces of the long wall portions 13*a* and the short wall portions 13*b*. In this way, the engaging portions 88 can easily engage the engaged portions 18 when the assisting tool 70 is mounted in the first housing 11, and keep the engaging portions 88 and engaged portions 18 from becoming disengaged.

A plurality of first terminals not shown in the drawings is arranged inside the recessed portion of the first housing 11. The number and arrangement of first terminals is changed in accordance with the number and arrangement of second terminals 161 so that the terminals can make contact with the second terminals 161 in the second connector 101.

The first connector 1 is mounted on the surface of an FPC 91 by soldering the tails of the first terminals to an exposed conductive trace on the surface of the front end portion of the FPC 91 (lower side face in FIG. 3). In the example shown, a reinforcing plate 92 is applied to the underside of the front end portion of the FPC 91 (the upper side face in FIG. 3).

When the first connector 1 is mated with the second connector 101, the mating face of the first connector 1 is positioned opposite the mating face of the second connector 101, and the first connector 1 and/or the second connector 101 is moved towards the other in the direction of mating. At this time, the entire first housing 11 of the first connector 1 is inserted into the recessed portion 112 of the second housing 111 of the second connector 101 from above in FIG. 3. The first terminals in the first connector 1 are brought into contact with the corresponding second terminals 161 in the second connector 101, and the mating is completed. As a result, an electrical connection is established with the conductive traces of the FPC 91 to which the tales of the first terminals of the first conductor 1 are connected and the conductive traces of the terminal connection pads connected to the tails of the second terminals 161 of the second conductor 101.

When the first connector 1 is mated to the second connector 101 is completed, nearly the entire first connector 1, excluding the FPC 91, is accommodated inside the recessed portion 112 of the second housing 111 of the second connector 101. As a result, the outer faces of the long wall portions 13*a* and the short wall portions 13*b* of the first housing 11 are covered by the long wall portions 113*a* and the short wall portions 113*b* of the second housing 111. However, gaps are formed between the outer faces of the long wall portions 13*a* of the first housing 11 and the inner faces of the long wall portions 113*a* of the second housing 111, and between the outer faces of the short wall portions 13*b* of the first housing 11 and the inner faces of the short wall portions 113*b* of the second housing 111, in which the front mounting portion 85 and side mounting portions 83 of the assisting tool 70 are inserted. In this way, the assisting tool 70 is mounted in the first housing 11 of the first connector 1, mated with the second connector 101.

When the mated first connector 1 and second connector 101 are released—that is, when the first connector 1 is removed from the second connector 101—the lower face of the assisting tool 70 is positioned to face the non-mated face of the first connector 1 as shown in FIG. 3, and the assisting tool 70 is moved closer to the first connector 1 to mount the tool. At this time, the front mounting portion 85 of the mounting member 81 of the assisting tool 70 is inserted from above in FIG. 3 into the gap formed between the long wall portion 13*a* at the front end of the FPC 91 in the first housing 11 of the first connector 1 and the long wall portion 113*a* of the second housing 111 of the second connector 101, and the side mounting portions 83 of the mounting member 81 of the assisting tool 70 are inserted from above in FIG. 3 between the short wall portions 13*b* of the first housing 11 of the first connector 1 and the short wall portions 113*b* of the second housing 111 of the second connector 101. When the assisting tool 70 is moved further in the direction of the non-mated face of the second connector 101, that is, further downward, the engaging portions 88 in the front mounting portion 85 and the side mounting portions 83*a* engage the corresponding engaging portions 18 in the long wall portion 13*a* and the short wall portions 13*b*. In this way, the mounting of the assisting tool 70 in the first connector 1 is completed as shown in FIGS. 4(*a*) and 5(*a*). In other words, more than half of the reinforcing plate 92 of the FPC 91 corresponding to the non-mated face of the first connector 1 is covered by the assisting tool 70.

Next, the cut-and-raised portion 72*a* formed in the operating member 71 of the assisting tool 70 is pulled by the operator using a finger to apply force to lift it up. In other words, the operating member 71 is rotated clockwise around the rotating shafts 64 as shown in FIG. 5(*a*)-(*d*). As shown in FIGS. 4(*b*) and 5(*b*), the rear end of the protruding portions 75 is displaced downward, and the abutting face 75*a* abuts the abutted face 115, or upper face, of the short wall portions 113*b* of the second housing 111 of the second connector 101, and the second housing 111 is pushed downward in the direction that releases the mated first connector 1.

When the operating member 71 is rotated further in the clockwise direction, shown in FIGS. 4(*c*) and 5(*c*), the rear end of the protruding portions 75 are displaced further downward, displacing the entire assisting tool 70 upward relative to the second housing 111. As a result, the first connector 1 to which the assisting tool 70 is mounted is displaced upward relative to the second connector 101, and the mated first connector 1 and the second connector 101 are released. Thus, the first connector 1 can be completely removed from the second connector 101, shown in FIGS. 4(*d*) and 5(*d*), by grasping and lifting up the assisting tool 70.

When the first connector 1 is to be removed from the second connector 101, the first connector 1 can be easily removed from the second connector 101 simply by mounting the assisting tool 70 on the first connector 1 and rotating the operating member 71 of the assisting tool 70. Also, the protruding portions 75 of the operating member 71 on both longitudinal ends of the first connector 1 and the second connector 101 function as lever portions to push down the second housing 111 of the second connector 101 in a relative sense. As a result, the mated first connector 1 and second connector 101 can be released without applying pressure to the various portions of the first connector 1 and second connector 101. As a result, the various portions of the first connector 1 and second connector 101 are unlikely to be damaged or destroyed. Also, because the lower panel 62*d* of the intermediate member 61 of the assisting tool 70 comes near or makes contact with the reinforcing plate 92 applied to the backside of the FPC 91, the FPC 91 and the first housing 111 of the first connector 1 are kept from being deformed. Because the assisting tool 70 is compact and hardly protrudes further out than the profile of the first connector 1 and the second connector 101, it can be mounted to the first connector 1 and used even when there is very little space surrounding the second connector 101 on the substrate.

Because there is a chance that the first connector 1 or the assisting tool 70 will become damaged once the engaged portions 18 of the first connector 1 have been disengaged from the engaging portions 88 of the assisting tool 70, the assisting tool 70 mounted on the first connector 1 should preferably remain mounted on the first connector 1 as shown in FIGS. 4(*d*) and 5(*d*). In this case, when the first connector 1 removed from the second connector 101 is once again mated to the second connector 101, the first connector 1 is mated with the second connector 101 while the assisting tool 70 remains mounted. Also, when the first connector 1 is scheduled to be removed from the second connector 101, the assisting tool 70 can be removed from the first connector 1 before the first connector 1 is initially mated with the second connector 101. The assisting tool 70 is compact and has a low profile, but there is a chance it will obstruct the FPC 91 from turning even when the assisting tool 70 is mounted in the first connector 1 mounted on the front end portion of the FPC 91.

When the second connector 101 has been mated with the first connector 1 mounted to the assisting tool 70, the assisting tool 70 can control the arrangement and orientation of the first connector 1. Also, when significant push-in force has to be applied to the first connector 1 when mating the first connector 1 with the second connector 101, the push-in force to the first connector 1 can be applied to the top panel portion 72 of the operating member 71 of the assisting tool 70.

In the present embodiment, the assisting tool 70 has a mounting member 81 which can be mounted in the first housing 11 of a first connector 1 which can be mated to a second connector 101 with a second housing 111, and an operating member 71 which can be rotated with respect to the mounting member 81. The operating member 71 has a protruding portion 75, and the mounting member 81 is mounted in the first housing 11. When the operating member 71 is rotated while the first connector 1 is mated to the second connector 101, the protruding portion 75 comes into contact with the second housing 111, and pressure is applied to the second housing 111 in the direction that releases the mated first connector 1 and second connector 101.

In this way, the mounting member 81 can be mounted in the first housing 11 of the first connector 1 and the operating member 71 rotated to simply remove the first connector 1 from the second connector 101. The first connector 1 or the second connector 101 does not have to be twisted and excessive force does not have to be applied. Thus, the first connector 1 and the second connector 101 are unlikely to be damaged. Because the assisting tool 70 is compact and has a low profile, it can be used even when the second connector 101 is mounted on the surface of a substrate used in an electronic device and there is very little surrounding space. Because the assisting tool 70 is compact, has a low profile, and is easy to operate, the first connector 1 can be easily removed from the second connector 101.

Further, the mounting member 81 has engaging portions 88 which are able to engage engaged portions 18 formed on the outer faces of the side wall portions 13 of the first housing 11. In this way, the mounting member 81 can be simply moved along the outer faces of the side wall portions 13 of the first housing 11 to engage the engaging portions 88 in the engaged portions 18. As a result, the mounting member 81 can be mounted in the first housing 11 of the first connector 1 easily and in a short time.

When the operating member 71 is rotated, the protruding portions 75 abut the abutted face 115 or upper face of the short wall portions 113*b* of the second housing 111 and push down on the second housing 111. Due to the principles of leverage, significant pressure is generated, and the first connector 1 can be removed from the second connector 101 without significant force.

The mounting member 81 has plate-shaped side mounting portions 83 and a front mounting portion 85. The side mounting portions 83 and a front mounting portion 85 can be inserted between the outer face of the side wall portions 13 of the first housing 11 and the inner face of the side wall portions 113 of the second housing 111 when the first connector 1 is mated with the second connector 101. Thus, the assisting tool 70 can be easily mounted in the first housing 11 of the first connector 11 while it is mated with the second connector 101. It also does not interfere and obstruct the mating operation when the first connector 1 is mated with the second connector 101 while the assisting tool 70 is mounted.

The mounting member 81 can be mounted to the first housing 11 of the first connector 1 while the second connector 101 is mated or before the second connector 101 is mated. Thus, the assisting tool 70 has a wide range of applications and uses.

Figure 6:
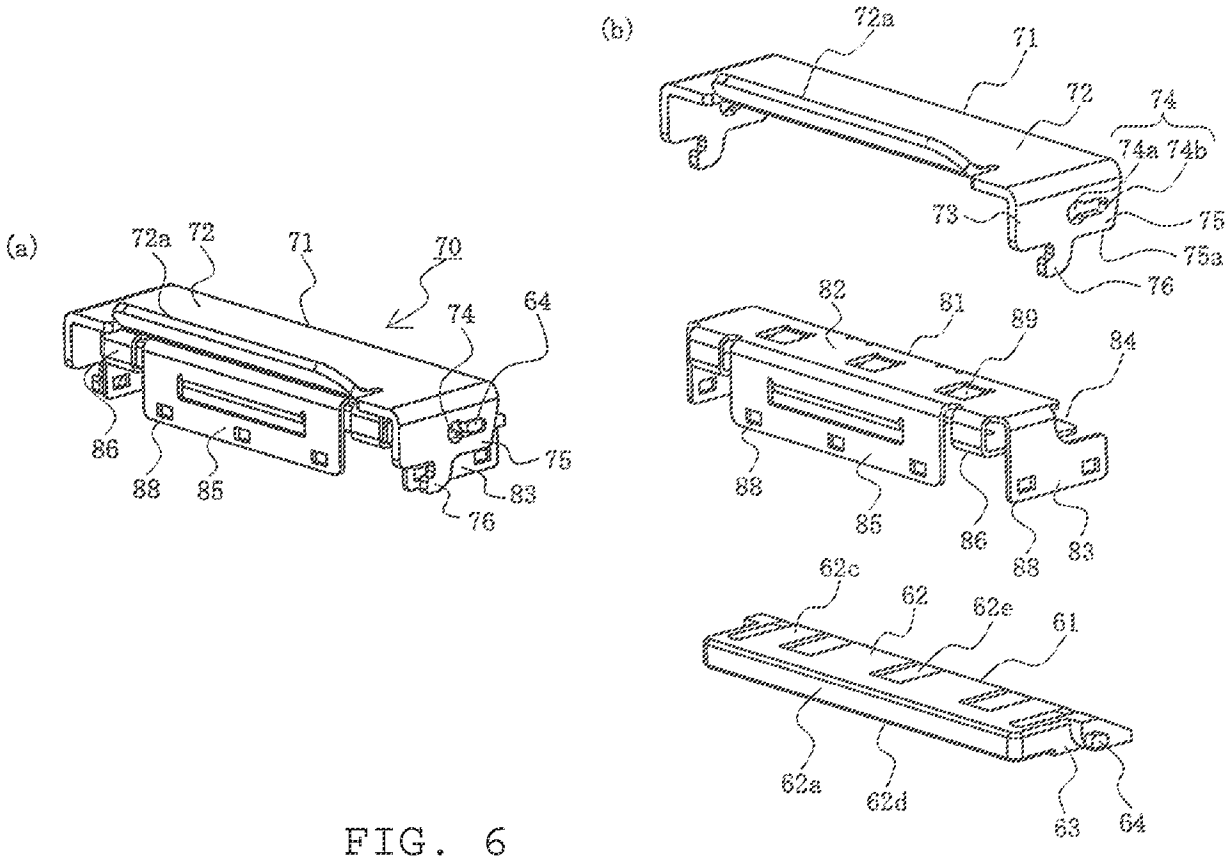
FIG. 6 shows perspective views of the assisting tool for a connector according to another embodiment of the Present Disclosure, as viewed from the front in which FIG. 6(*a*) is an assembled view, and FIG. 6(*b*) is an exploded view.
Figure 7:
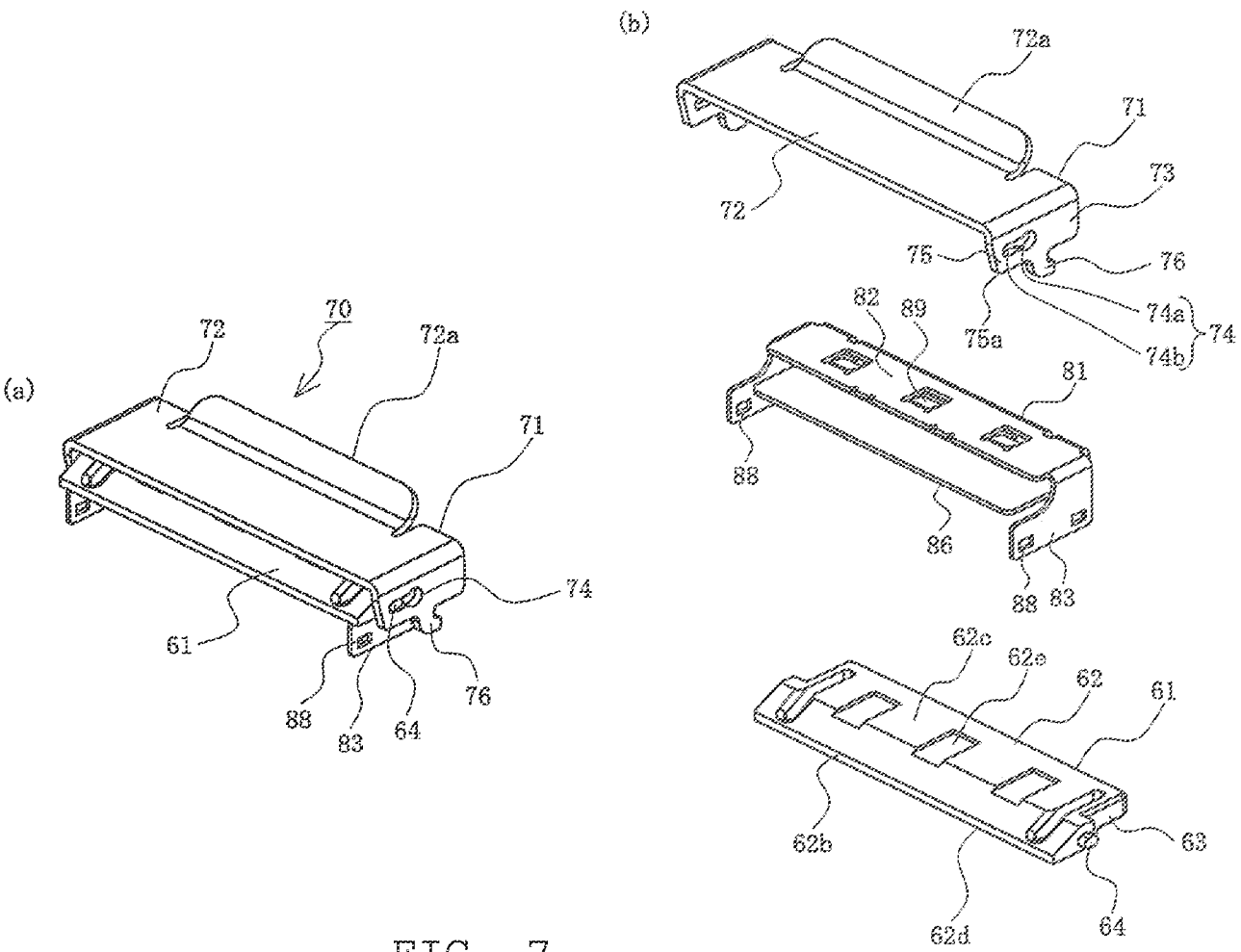
FIG. 7 shows perspective views of the tool of FIG. 6, as viewed from the rear in which FIG. 7(*a*) is an assembled view, and FIG. 7(*b*) is an exploded view.

FIGS. 6-7 illustrate a second embodiment of the Present Disclosure. The configurational elements identical to those in the first embodiment are denoted by the same reference numbers, and further explanation of these elements has been omitted. Further explanation of operations and effects that are identical to those in the first embodiment has also been omitted.

The bearing portions 74 formed in the side panel portions 73 of the operating member 71 of the assisting tool 70 in the present embodiment have a large-diameter portion 74*a* and a slit portion 74*b* extending to the rear from the large-diameter portion 74*a*. Also, the rotating shafts 64 of the intermediate members 61 are not cylindrical as in the first embodiment, but are column-shaped with an oval-shaped cross section extending longitudinally. When the rotating shafts 64 are inserted into the bearing portions 74, the rotating shaft 64 cannot rotate inside the slit portion 74*b* but can rotate inside the large-diameter portion 74*a* as shown in FIGS. 6(*a*) and 7(*a*).

A hook portion 76 is connected to the bottom end of the side panel portions 73 of the operating member 71, and the hook portion 76 has a substantially L-shaped planar shape in which a portion extending vertically is joined with a portion extending longitudinally. The longitudinally extending portion of the hook portion 76 extends forward. The protruding portions 75 do not protrude as far as those in the first embodiment. However, as in the first embodiment, they function as lever portions when the first connector 1 is to be removed from the second connector 101, and the bottom ends function as abutting faces 75*a* abutting the second housing 111 of the second connector 101.

The portion extending longitudinally in the pair of intermediate member front holding portions 86 of the mounting member 81 are connected to each other integrally. The intermediate member rear holding portion 87 has been omitted. An locking piece 89 extending downward is formed in the frame portion 82. The locking piece 89 engages an engaging groove 62*e* formed in the upper panel 62*c* of the intermediate member 61, and prevents rearward movement of the intermediate member 61 of the mounting member 81.

In the present embodiment, when the operating member 71, the mounting member 81, and the intermediate member 61 are assembled, the main portion 62 of the intermediate member 61 is held by the intermediate member front holding portion 86 so that the upper panel 62*c* of the main portion 62 faces the lower face of the frame portion 82 of the mounting member 81. Also, the locking piece 89 of the mounting member 81 engages the engaging groove 62*e* of the intermediate member 61. Then, the rotating shafts 64 are inserted into the bearing portions 74 and the operating member 71 is mounted in the intermediate member 61 so that the top panel portion 72 of the operating member 71 covers the upper face of the frame portion 82 of the mounting member 81.

In this way, the assisting tool 70 shown in FIGS. 6(*a*) and 7(*a*) can be obtained. When the rotating shaft 64 is positioned inside the large-diameter portion 74*a* of the bearing portion 74, the operating member 71 can be rotated or pivoted around the rotating shaft 64 with respect to the intermediate member 61 and the mounting member 81.

When the rotating shaft 64 is positioned inside the slit portion 74*b* of the bearing portion 74, the rotating shaft 64 can slide but cannot rotate or pivot with respect to the intermediate member 61 and the mounting member 81.

The other configurational elements of the assisting tool 70 are similar to those of the first embodiment, so further explanation of these elements has been omitted.

Figure 8:
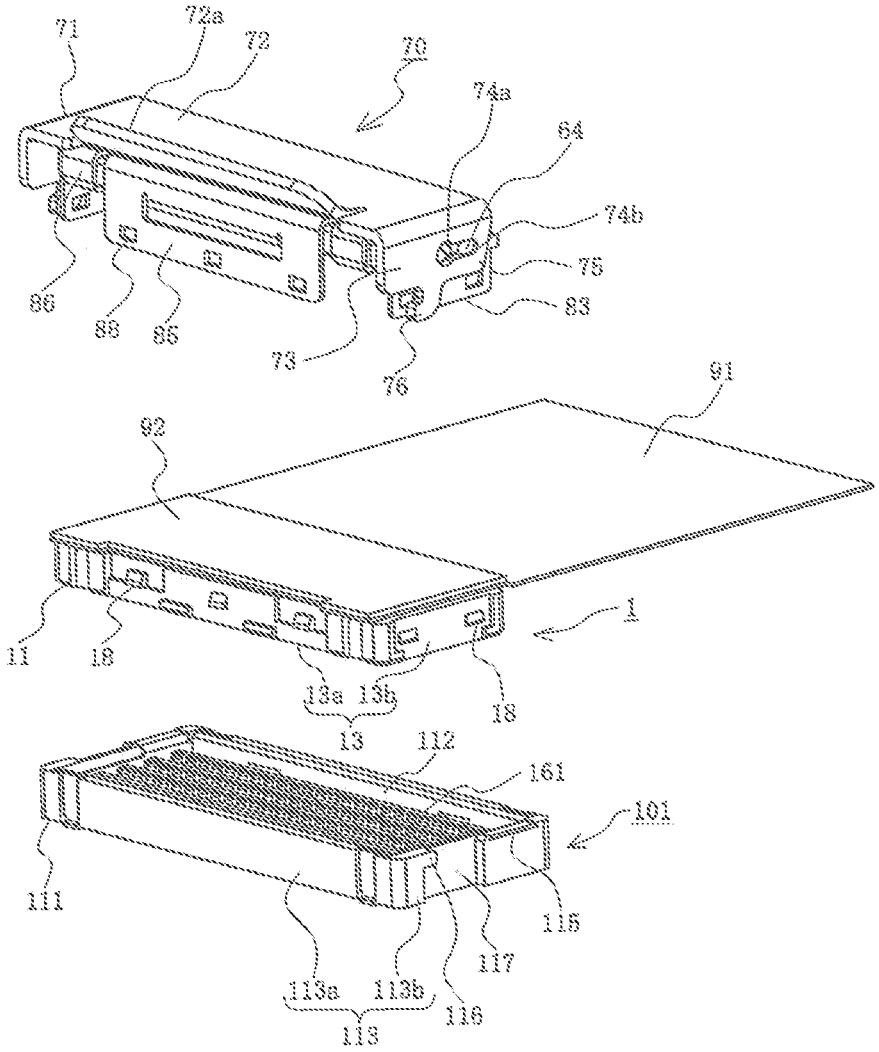
FIG. 8 shows a perspective view showing the relationship between the tool of FIG. 6 and the first and second connectors.

FIGS. 8-13 illustrate the operation of the operating member 71 of the present embodiment. FIG. 8 shows the first connector 1 and the second connector 101 before mating. The assisting tool 70 has also not yet been mounted on the first connector 1.

In the present embodiment, a hook accommodating recessed portion 117 is formed in the short wall portions 113*b* of the second housing 111 of the second connector 101 to receive the hook portions 76 of the assisting tool 70, and a hooked portion 116 is formed in the front end of each hook accommodating recessed portion 117 to engage a hook portion 76. The hook accommodating recessed portion 117 is recessed by forming a vertically extending wide but thin groove in the outer face of the short wall portion 113*b*. The hook portion 116 has a shape which extends to the rear from the linear boundary extending vertically at the front end of the hook accommodating recessed portion 117, and is flush with the outer face of the short wall portion 113*b*. The upper face of the short wall portion 113*b* functions as an abutted face 115 and is missing in the portion with the hook accommodating recessed portion 117.

The other configurational elements of the second connector 101 in the present embodiment are similar to those of the first embodiment, so further explanation of these elements is omitted. The first connector 1 and the FPC 91 are similar to those in the first embodiment, so further explanation of these elements is omitted.

In the explanation of the first embodiment, the assisting tool 70 was mounted on a first connector 1 already mated with a second connector 101 when the first connector 1 was to be removed from the second connector 101. In the explanation of the present embodiment, the assisting tool 70 is mounted on the first connector 1 before the first connector 1 has been mated with the second connector 101. In the explanation of the present embodiment, the assisting tool 70 has already been mounted on the first connector 1.

Here, the operator, as shown in FIG. 8, positioned the lower face of the assisting tool 70 to face the non-mated face of the first connector 1, and the assisting tool 70 is moved towards the first connector 1 to be mounted. More specifically, the assisting tool 70 is moved with respect to the first connector 1 so that the front mounting portion 85 and the side mounting portions 83 of the mounting member 81 of the assisting tool 70 move downward along the outer faces of the long wall portion 13*a* and the short wall portions 13*b*. Then, the engaging portions 88 of the front mounting portion 85 and the side mounting portions 83 engage the corresponding engaged portions 18 in the long wall portion 13*a* and the short wall portions 13*b*.

Figure 9:
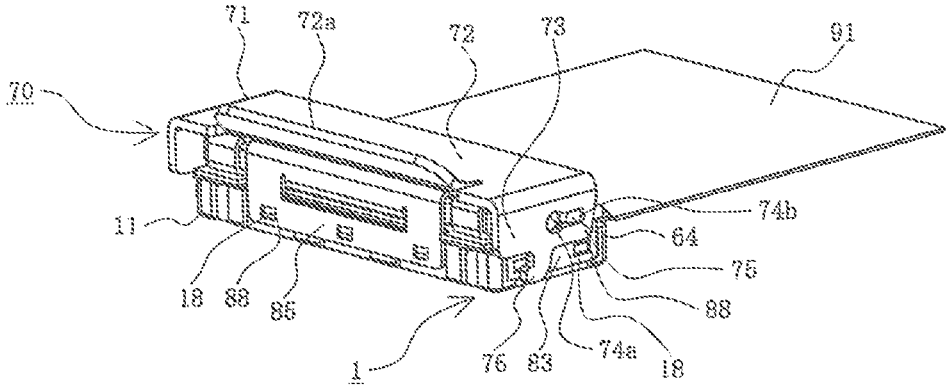
FIG. 9 shows a perspective view showing the tool of FIG. 6 mounted in the first connector.

In this way, the mounting of the assisting tool 70 in the first connector 1 is completed as shown in FIG. 9. In other words, more than half of the reinforcing plate 92 of the FPC 91 corresponding to the non-mated face of the first connector 1 is covered by the assisting tool 70.

When the first connector 1 and the second connector 101 are mated, the operator positions the mated face of the first connector 1 with the mounted assisting tool 70 to the mated face of the second connector 101, and the connectors are mated by moving the first connector 1 and/or the second connector 101 towards the other in the mating direction. The operating member 71 of the assisting tool 70 has already been slid to the rear with respect to the intermediate member 61 and the mounting member 81. More specifically, the rotating shafts 64 are positioned inside the large-diameter portions 74*a* of the bearing portions 74 by sliding the operating member 71 to the rear from the state in which the rotating shafts 64 are positioned inside the slit portions 74*b* of the bearing portions 74 as shown in FIG. 9.

Next, the operator inserts the entire first housing 11 of the first connector 1 into the recessed portion 112 of the second housing 111 of the second connector 101 from above in FIG. 8. In the present embodiment, as in the first embodiment, the front mounting portion 85 and the side mounting portions 83 of the mounting member 81 of the assisting tool 70 are inserted after mating into the gap formed between the long wall portion 13*a* in the first housing 11 and the long wall portion 113*a* in the second housing 111, and between the short wall portions 13*b* in the first housing 11 and the short wall portions 113*b* in the second housing 111. In this way, the front mounting portions 85 and the side mounting portions 83 of the mounting member 81 of the assisting tool 70 mounted in the first connector 1 are also inserted into the recessed portion 112 of the second housing 111.

However, because the side panel portions 73 of the operating member 71 of the assisting tool 70 are positioned directly above the short wall portions 113*b* of the second housing 111, they cannot be inserted into the recessed portion 112 of the second housing 111. However, the hook portions 76 extending downward from the bottom ends of the side panel portions 73 are inserted into the hook accommodating recessed portions 117 formed in the outer face of the short wall portions 113*b* of the second housing 111.

Figure 10:
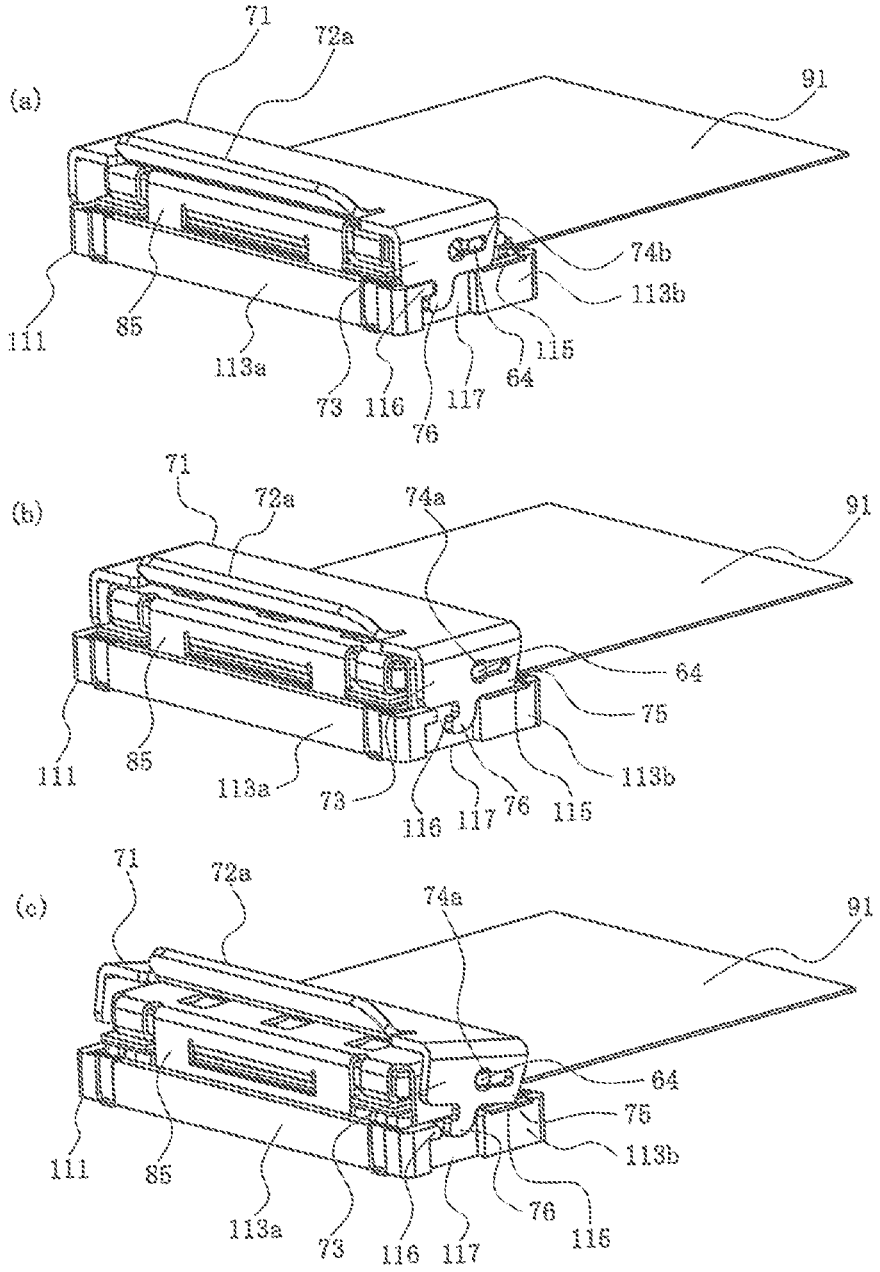
FIG. 10 shows a perspective view used to explain steps (a)-(c) of the removal operation, to remove the first connector from the second connector using the tool of FIG. 6.

When the first terminals of the first connector 1 come into contact with the corresponding second terminals 161 of the second connector 101 and are mated, the operator slides the operating member 71 of the assisting tool 70 forward with respect to the intermediate member 61 and the mounting member 81. Then, as shown in FIGS. 10(*a*) and 12(*a*), the hook portions 76 of the operating member 71 engage the hooked portions 116 formed in the front ends of the hook accommodating recessed portions 117 of the second housing 111. The rotating shafts 64 are positioned inside the slit portion 74*b* of the bearing portions 74, and the operating member 71 cannot rotate. In this way, the operating member 71, as shown in FIGS. 10(*a*) and 12(*a*), is locked in the second housing member 111, and the mating of the first connector 1 and the second connector 101 is completed.

When the mating has been completed, the operating member 71 does not come out of the second housing 111 even when force is applied upward or in the releasing direction. Therefore, the first connector 1 with the mounted assisting tool 70 and the second connector 101 are reliably kept from coming apart needlessly.

When the mated first connector 1 and the second connector 101 are to be released, that is, the first connector 1 is to be removed from the second connector 101, the operator lifts up the cut-and-raised portion 72*a* formed in the operating member 71 of the assisting tool 70, and the operating member 71 is slid rearward from the state shown in FIGS. 10(*a*) and 12(*a*). Then, as shown in FIGS. 10(*b*) and 12(*b*), the operating member 71 is displaced to the rear, and the hook portions 76 of the operating member 71 are disengaged from the hooked portions 116 formed in the front end of the hook accommodating recessed portions 117 of the second housing 111. The rotating shafts 64 are then positioned inside the large-diameter portion 74*a* of the bearing portions 74, and the operating member 71 can rotate.

Figure 12:
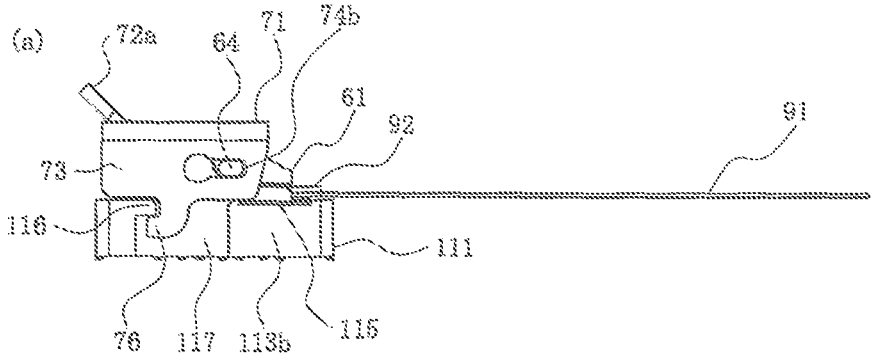
FIG. 12 shows a side view to explain steps (a)-(c) of the removal operation of FIG. 10.
Figure 12:
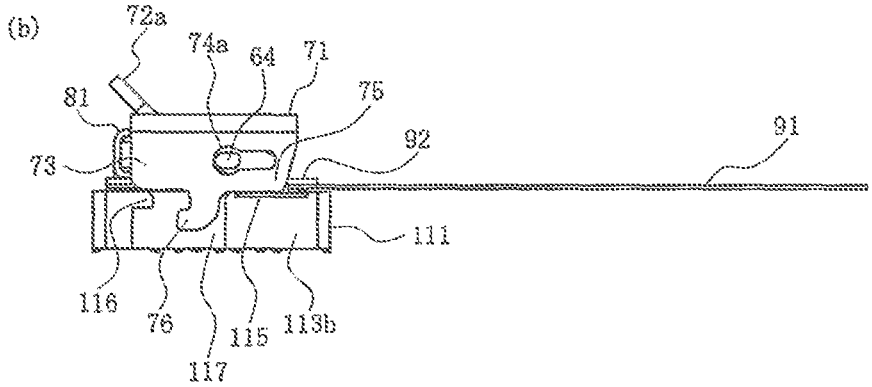
Figure 12:
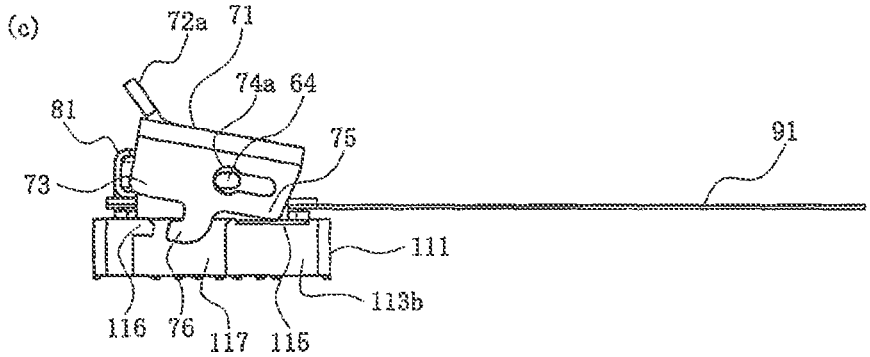
Figure 13:
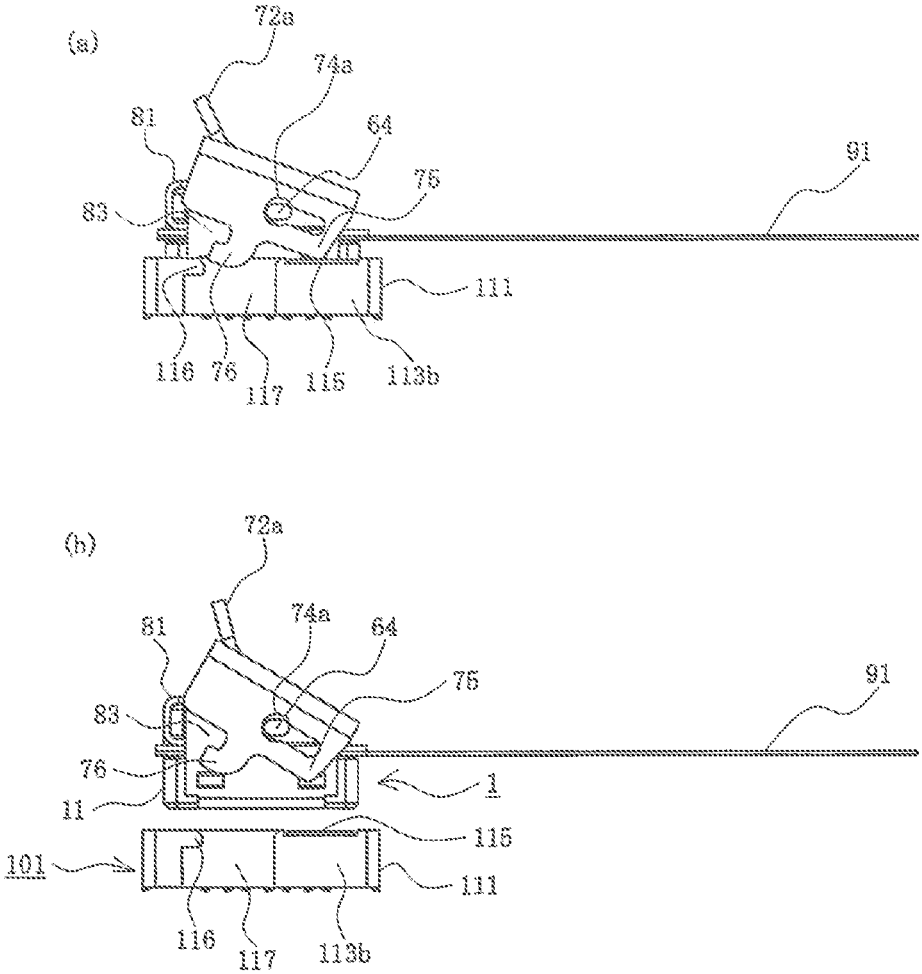
FIG. 13 shows a side view to explain steps (a)-(b) of the removal operation of FIG. 11.
Figure 14:
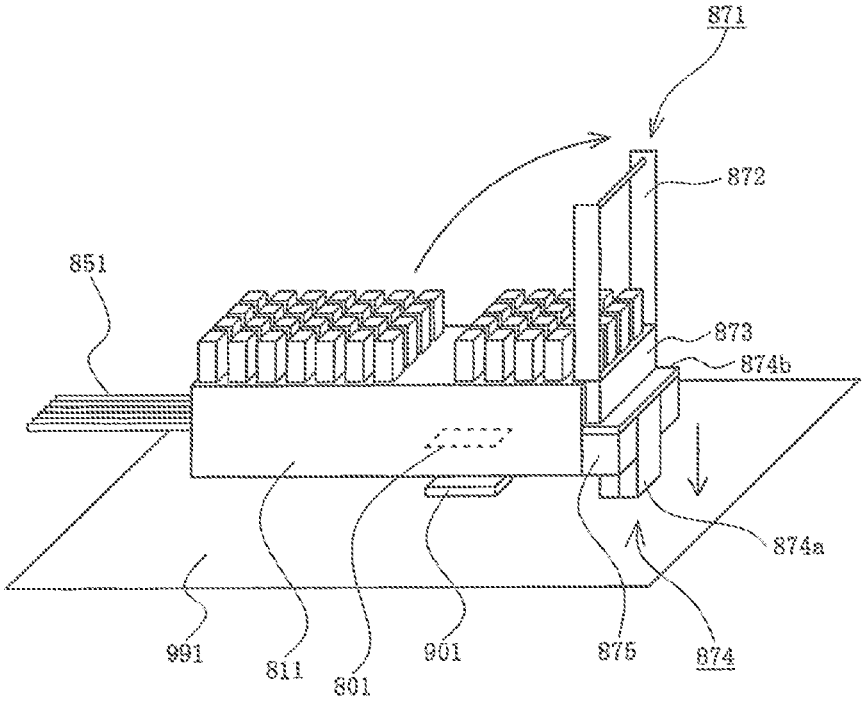
Prior Art FIG. 14
FIG. 14 shows a perspective view showing a conventional assisting tool used to remove a connector.

Next, the operator applies force to the cut-and-raised portion 72*a* formed in the operating member 71. In other words, the operating member 71 is rotated clockwise around the rotating shafts 64 as shown in FIGS. 12(*a*)-(*c*). As shown in FIGS. 10(*c*) and 12(*c*), the rear end of the protruding portions 75 of the operating member 71 is displaced downward, and the abutting face 75*a* abuts the abutted face 115, or upper face, of the short wall portions 113*b* of the second housing 111 of the second connector 101, and the abutted face 115 is displaced downward in a relative sense. In this way, the assisting tool 70 and the first connector 1 are displaced upward relative to the second connector 101.

Figure 11:
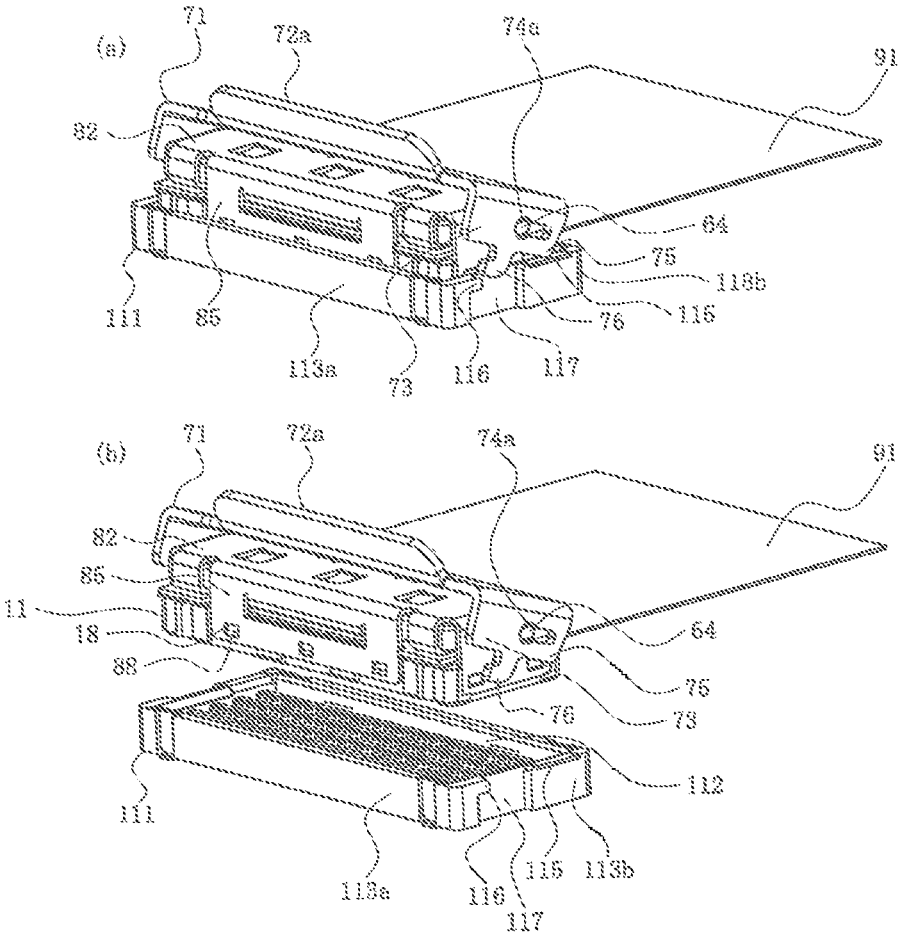
FIG. 11 shows a perspective view to explain steps (a)-(b) of the removal operation of FIG. 10.

When the operator rotates the operating member 71 further in the clockwise direction, as shown in FIGS. 11(*a*) and 13(*a*), the rear end of the protruding portions 75 are displaced further downward, and the assisting tool 70 and the first connector 1 are displaced further upward relative to the second connector 101. As a result, the mated first connector 1 and second connector 101 are released.

Therefore, the operator grips and lifts the assisting tool 70 to completely remove the first connector 1 from the second connector 101 as shown in FIGS. 11(*b*) and 13(*b*).

When removing the first connector 1 from the second connector 101, the hook portion 76 can be disengaged from the hooked portion 116 and the connector 1 removed from the second connector 101 simply by sliding and then rotating the operating member 71 of the assisting tool 70.

As in the first embodiment, the assisting tool 70 in the present embodiment may be attached to a first connector 1 already mounted to a second connector 101 when the first connector 1 is to be removed from the second connector 101.

Because the effects of the other elements are the same as those of the first embodiment, further explanation has been omitted.

In the present embodiment, the operating member 71 has a bearing portion 74 into which a rotating shaft 64 fixed to the mounting member 81 has been rotatably and slidably inserted, and a hook portion 76 able to engage a hooked portion 116 formed in a side wall portion 113 of the second housing 111. The hook portion 76 is disengaged from the hooked portion 116 by sliding the operating member 71.

This reliably prevents the first connector 1 and the second connector 101 from becoming unmated on their own. It also easily disengages the hook portion 76 from the hooked portion 116 to remove the first connector 1 from the second connector 101.

Because the effects of the other elements are the same as those of the first embodiment, further explanation has been omitted.

While a preferred embodiment of the Present Disclosure is shown and described, it is envisioned that those skilled in the art may devise various modifications without departing from the spirit and scope of the foregoing Description and the appended Claims.

What is claimed is:

1. An assisting tool used to unmate a first connector from a second connector, the assisting tool comprising:

a mounting member configured to be mounted on the first connector;

an intermediate member mounted and fixed to the mounting member; and an operating member mounted in the intermediate member, the operating member being rotatable and pivotable relative to the intermediate member and the mounting member, whereby when the operating member is rotated and pivoted relative to the intermediate and mounting members, the operating member is configured to apply pressure to the second connector, thereby causing the first and second connectors to unmate from each other, and wherein the operating member has a top panel portion and side panel portions which extend downwardly from opposite ends of the top panel portion, the side panel portions include bearing portions and protruding portions, the protruding portions protruding rearwardly and downwardly from lower rear end corners of the side panel portions, the bearing portions having a through-hole.

2. The assisting tool as defined in claim 1, wherein the mounting member is configured to be mounted on the first connector either when the first and second connectors are mated to one another, or prior to the second connector being mated to the first connector.

3. The assisting tool as defined in claim 1, wherein the operating member has a cut-and-raised portion formed in a front edge of the top panel portion.

4. The assisting tool as defined in claim 1, wherein the mounting member has a frame portion, side mounting portions connected and extending downwardly from opposite ends of the frame portion, and a front mounting portion connected and extending downwardly from a front edge of the frame portion, and wherein a recessed portion is formed between the frame portion and each side mounting portion, each side mounting portion and the front mounting portion including at least one engaging portion configured to engage the first connector.

5. The assisting tool as defined in claim 4, wherein the mounting member has holding portions extending from the frame portion which are configured to hold the intermediate member.

6. The assisting tool as defined in claim 4, wherein the intermediate member has a main portion and a rotating shaft extending outward from opposite sides of the main portion, the main portion being held by the mounting member, the rotating shaft being inserted through the through-holes of the bearing portions of the operating member and being rotatably held by the bearing portions.

7. The assisting tool as defined in claim 4, wherein the through-hole has a large-diameter portion and a slit portion extending rearwardly from the large-diameter portion, and wherein the intermediate member has a main portion and a rotating shaft extending outward from opposite sides of the main portion, the main portion being held by the mounting member, the rotating shaft being inserted through the through-holes of the bearing portions of the operating member, the rotating shaft being rotatable within the large-diameter portion, the rotating shaft not being rotatable within the slit portion, but being able to slide within the slit portion.

* * * * *